United States Patent [19]

Carey et al.

[11] 4,129,025

[45] Dec. 12, 1978

[54] METHOD OF FABRICATING AN EXPULSION TANK DIAPHRAGM

[75] Inventors: Lee F. Carey; Anthony J. Friona, both of North Tonawanda, N.Y.

[73] Assignee: Textron Inc., Providence, R.I.

[21] Appl. No.: 772,331

[22] Filed: Feb. 25, 1977

[51] Int. Cl.[2] ..... B21D 22/24

[52] U.S. Cl. ..... 72/348; 113/116 B; 138/30

[58] Field of Search ..... 222/1, 95, 386.5; 72/68, 348; 138/30; 220/85 B; 113/120 AA, 116 B

[56] References Cited

U.S. PATENT DOCUMENTS

| | | | |
|---|---|---|---|
| 3,275,193 | 9/1966 | Barr | 222/95 |
| 3,471,349 | 10/1969 | Cohen | 222/386.5 X |
| 3,494,513 | 2/1970 | Bauer | 222/386.5 |
| 3,711,027 | 1/1973 | Carey | 239/265.19 |
| 3,940,031 | 2/1976 | Fishman | 222/386.5 |
| 3,957,005 | 5/1976 | Heffner | 72/348 X |
| 4,051,707 | 10/1977 | Valek et al. | 72/348 |

FOREIGN PATENT DOCUMENTS

| | | | |
|---|---|---|---|
| 998182 | 7/1965 | United Kingdom | 222/95 |

OTHER PUBLICATIONS

*Metals Handbook*, 8th edition Ohio, American Society For Metals, 1969, pp. 178–180, 187.

*Primary Examiner*—Allen N. Knowles
*Assistant Examiner*—Fred A. Silverberg

[57] ABSTRACT

A diaphragm adapted for use in a positive expulsion tank is subjected to a pre-rolling operation prior to installation within a tank in order to provide for improved diaphragm rolling characteristics during a subsequent expulsion operation.

4 Claims, 7 Drawing Figures

Fig. 2a.
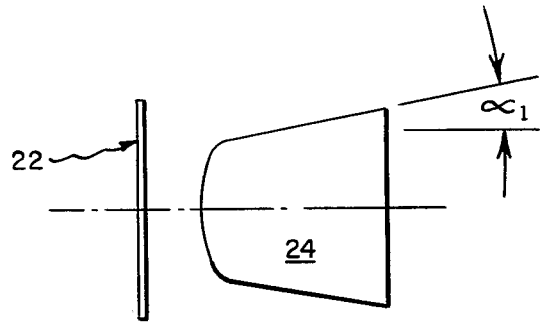
Fig. 2b.
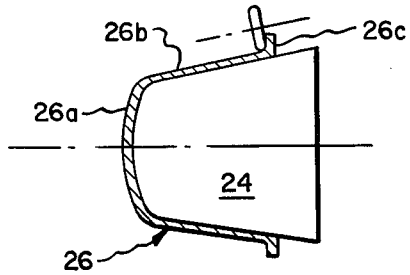
Fig. 2c.
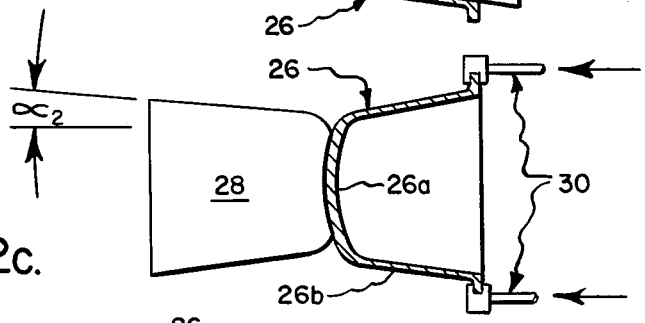
Fig. 2d.
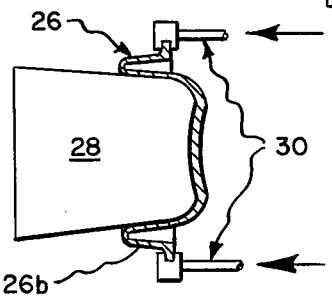
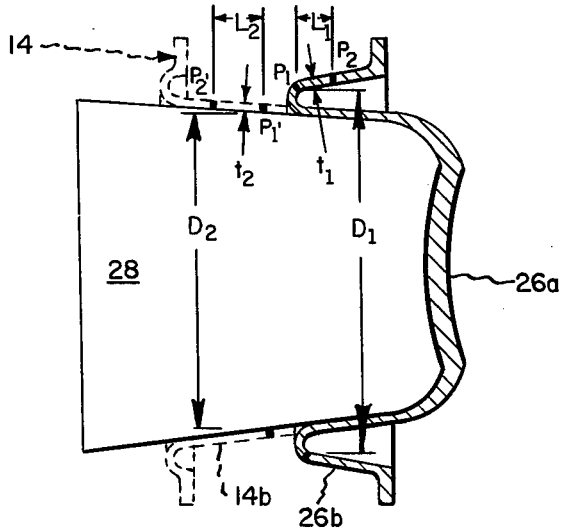
Fig. 3.

Fig. 5.
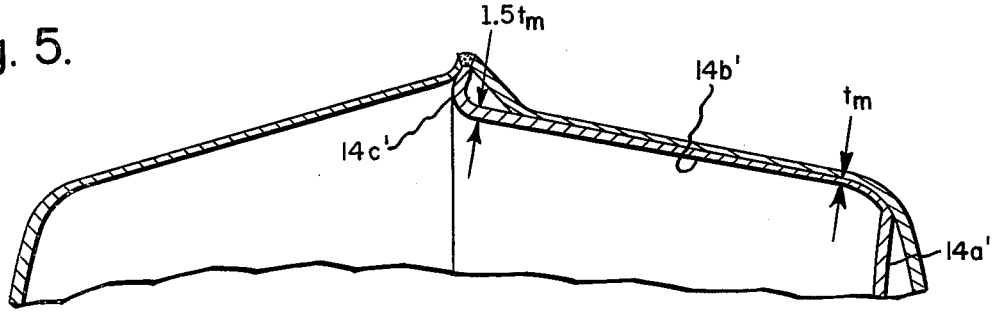
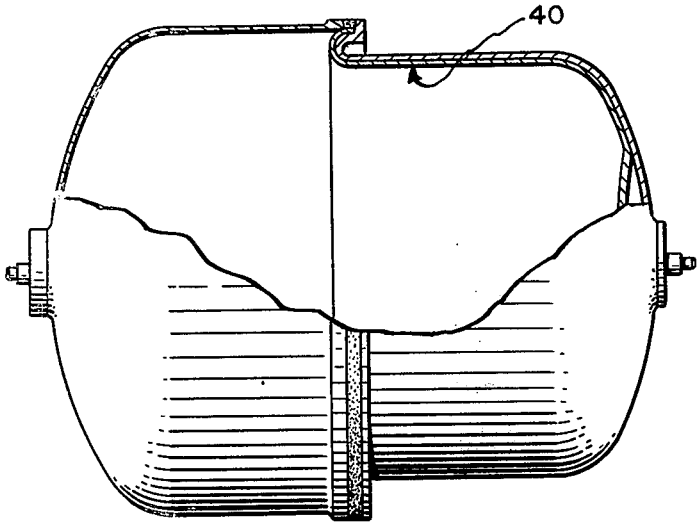
Fig. 6.
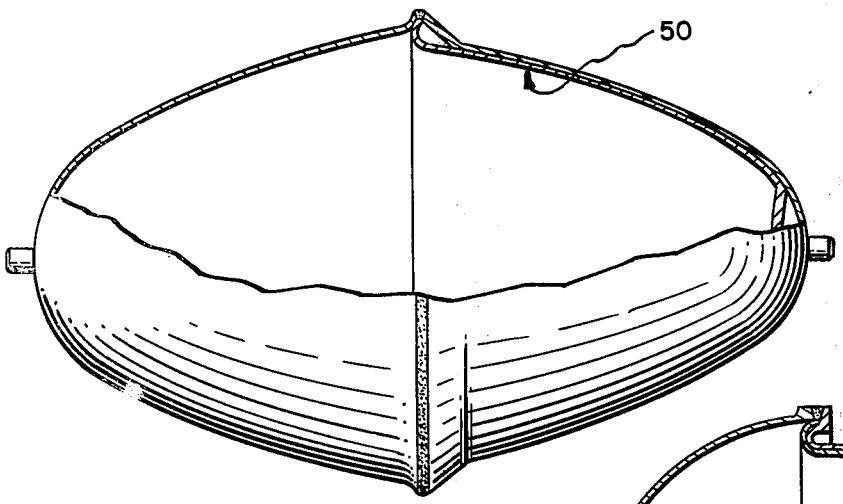
Fig. 7.
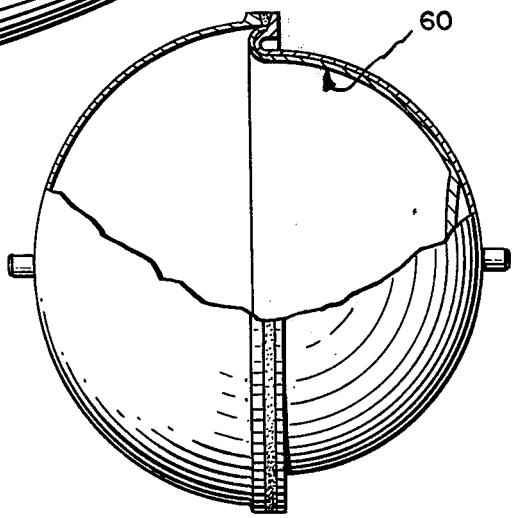
Fig. 8.

METHOD OF FABRICATING AN EXPULSION TANK DIAPHRAGM

BACKGROUND OF THE INVENTION

Metal bladders for positive expulsion tanks or like product storage devices are presently well known in the art. As by way of example, U.S. Pat. No. 3,275,193 discloses a product storage container, wherein a cup-shaped diaphragm or bladder is formed of a malleable material, such as aluminum, steel, nickel, etc., which is capable of cold flow incremental rolling bending movement to a substantially permanent plastic deformation. A rim portion of the cup-shaped diaphragm is secured to the juncture of a pair of cup-shaped shell portions, which cooperate to define a container or tank divided by the diaphragm into two compartments or chambers. Product stored in one of these compartments may be expelled from the container by means of a pressurized gas introduced into the other compartment; the difference in pressure across the diaphragm serving to effect rolling of the diaphragm upon its self to eventually assume an inside out or inverted configuration incident to essentially complete expulsion of the product from the container. With a diaphragm construction of the type disclosed in this patent, it is critical that the diaphragm be designed to "roll" at a pressure less than the pressure at which the diaphragm will be subject to buckling deformation, such as would otherwise result in failure of the diaphragm and/or the trapping of product within the container.

Prior attempts to insure proper roll deformation of expulsion tank and like diaphragms have principally led to "geometric" solutions of the buckling problem, including increasing the side wall thickness of the diaphragm, reducing the length to diameter ratio of the diaphragm, sloping or curving the side walls of the diaphragm and/or reinforcing the side walls of the diaphragm by providing separate reinforcement elements or forming such side walls with undulating folds or as a series of stepped diameter cylinders, as discussed for instance in U.S. Pat. Nos. 3,275,193 and 3,494,513.

Reference is also made to U.S. Pat. No. 3,711,027, which discloses an extendable nozzle for rocket engines, which was fabricated to a frusto-conical configuration and then partially telescopically rolled upon itself to provide a nozzle having a reduced longitudinal dimension in its "stowed" condition.

As with rolling expulsion diaphragms of the type disclosed in U.S. Pat. No. 3,494,513, it was the practice to subject the fabricated nozzle to an annealing operation in order to remove stresses introduced into the diaphragm material during fabrication with a view towards reducing rolling, ie. gas deployment, pressure to a minimum. As a practical matter, it was found necessary to provide the nozzle with a rolling guide or filler boundary in order to avoid buckling failure of the nozzle within acceptable ranges of the ratios "D"/"t" and "L"/"D", wherein "D", "t" and "L" are the diameter, wall thickness and length of the nozzle.

During subsequent studies of mechanically extendable stainless steel nozzles, it was noted that when a previously deployed nozzle was re-rolled into its original "stowed" configuration, its diameter had enlarged such that it did not contact the rolling guide or filler boundary employed during the previous deployment cycle and that the rolling guide performed no function during a subsequent deployment cycle. A study of this phenomena led to the conclusion that the rolling of the nozzle upon itself during the previous deployment cycle served to change the critical buckling/rolling pressure relationship of the material from which the nozzle was fabricated. It was then determined that nozzles which heretofore could not be deployed without the provision of a rolling guide or filler boundary to prevent buckling failure of a nozzle, could be successfully deployed if such nozzles were previously rolled and not subjected to a conventional annealing operation, while in their pre-rolled condition. This study subsequently led to the conclusion that the above mentioned phenomena could be used to advantage in fabricating an expulsion diaphragm having a markedly improved critical buckling pressure/rolling pressure relationship, as compared to prior diaphragm constructions.

SUMMARY OF THE INVENTION

The present invention is directed towards diaphragms adapted for use in positive expulsion tanks or the like and more particularly towards a diaphragm characterized in that directional residual stresses and strains placed in the material forming the diaphragm incident to a pre-rolling operation are employed to control and stabilize deformation of the diaphragm during a product expulsion operation.

The diaphragm of the present invention may be fabricated by shear spinning or otherwise deforming a flat disc or blank of a suitable product compatible material onto a mandrel to provide a generally cup shaped preform having a relatively thick, unspun base wall or central section. After the preform is annealed or otherwise treated to reduce stresses created in the material incident to the shear spinning or initial forming operation, it is rolled onto a mandred to pre-roll and convolute or invert same to form the finished diaphragm.

The pre-rolling operation imparts directional residual stresses and strains to the material forming the diaphragm, which are used to control and stabilize back rolling of the diaphragm during a subsequent expulsion operation. The configuration assumed by the diaphragm at the completion of an expulsion operation corresponds essentially to the configuration of the preform.

The mode of forming a diaphragm in accordance with the present invention serves to substantially increase its resistance to buckling deformation over a conventional diaphragm having the same diameter and wall thickness. Thus, as by way of example, the improved buckling characteristics of the present diaphragm construction enables it to be formed with a length approximately twice that of a conventionally formed diaphragm, of like diameter and wall thickness, such that maximum product storage efficiency is achieved.

DRAWINGS

The nature and mode of operation of the present invention is now more fully described in the following detailed description taken with the accompanying drawings wherein:

FIG. 1 is a side elevational view of an expulsion tank, wherein the tank shell is partially broken away to show an expulsion diaphragm or bladder formed in accordance with the present invention;

FIGS. *2a–2d* are schematic views illustrating the steps in the fabrication of the diaphragm of the present invention;

FIG. 3 is an enlarged view of the fabrication step illustrated in FIG. 2d;

FIG. 5 is a partial sectional view taken through an expulsion tank showing a frusto-conically shaped diaphragm having a tapered wall thickness; and FIGS. 6–8 are views similar to FIG. 1, but illustrating alternative expulsion tank/diaphragm geometries.

DETAILED DESCRIPTION

Figure 1:
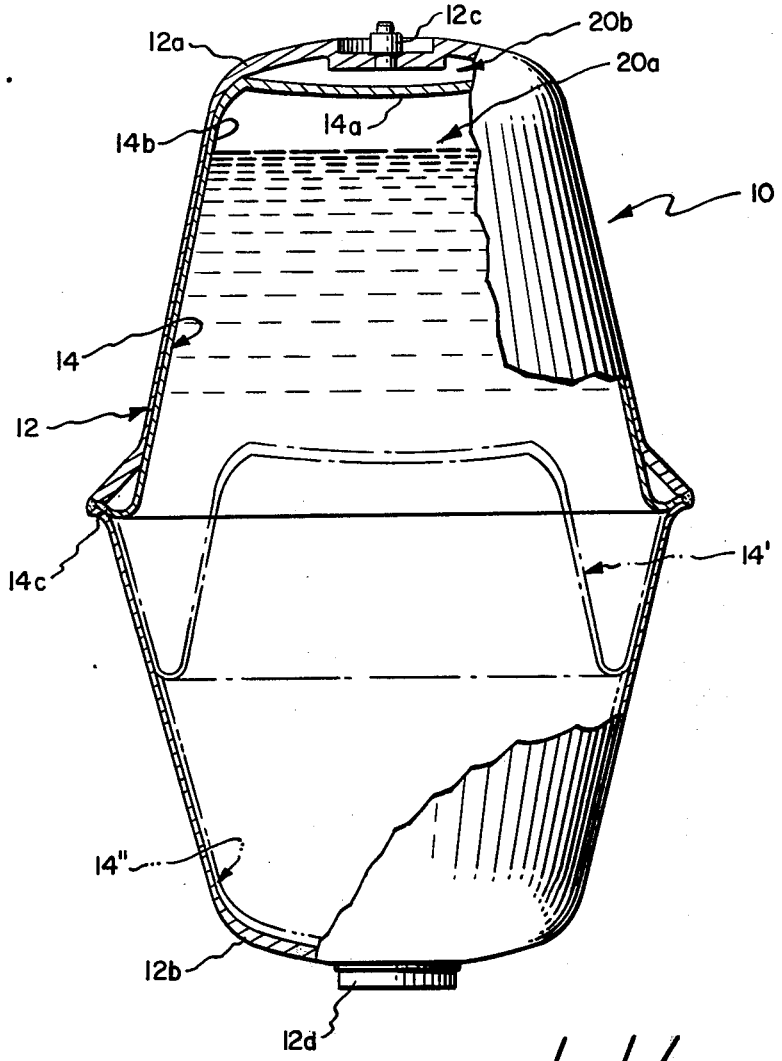

Reference is now made particularly to FIG. 1, wherein a positive expulsion tank is generally designated as 10 and shown as including a tank shell 12 enclosing a pre-rolled diaphragm 14 formed in accordance with the present invention.

Tank shell 12 is shown as being of conventional construction in that it is formed by rim joining a pair of shear spun tank half shells 12a and 12b having suitable expulsion fluid inlet and product discharge or outlet devices 12c and 12d, respectively. By making reference to FIG. 1, it will be understood that half shells 12a and 12b vary slightly in size to accommodate for changes in the shape of diaphragm 14 incident to a product expulsion operation.

Diaphragm 14 is shown in FIG. 1 as being of a generally cup-shaped configuration having a bottom wall or base portion 14a, a frusto-conically shaped side wall portion 14b and a rim portion 14c, which is suitably secured to the tank shell, as by being welded to half shells 12a and 12b adjacent their juncture.

Diaphragm 14 serves to divide the interior of tank shell 12 into separate product storage and expulsion fluid chambers 20a and 20b. It will be understood that the creation of a pressure differential across diaphragm 14, as by introducing an expulsion fluid, such as a gas under pressure into chamber 20b, while outlet device 12d is open, causes the diaphragm to roll upon itself from its tank full configuration shown in full line, through an intermediate configuration shown in broken line at 14' into a fully inverted or tank empty configuration designated in broken line at 14". The construction is such that the diaphragm rolls into firm contact with the inside wall of half shell 12b in order to displace all of the stored product, (except for a minor surface film and residues in the discharge device 12d), thereby permitting an expulsion efficiency of about 99% to be achieved.

As generally indicated in FIGS. 2a and 2b, diaphragm 14 is preferably fabricated by a process involving the initial step of shear spinning a circular plate or sheet 22 of a product compatible material, onto a mandrel 24 in order to form a frusto-conically shaped diaphragm or article preform 26 having a relatively thick unspun central or base portion 26a and frusto-conically shaped side wall 26b and a rim portion 26c. Preform 26 is then subjected to a conventional annealing operation to remove residual stresses developed during the forming process. Preferably, mandrel cone half angle $\alpha_1$ would be at least 15% in order to permit single stage shear spin forming. However, this angle may be departed from, particularly where preform 26 is to be otherwise fabricated, as by a casting or molding operation.

The thus fabricated preform is then pre-rolled onto a second mandrel 28 having a cone half angle $\alpha_2$, which would normally be equal to or slightly smaller than angle $\alpha_1$ by means of a clamp device 30, as indicated in FIGS. 2c, 2d and 3 in order to form diaphragm 14. The thus formed diaphragm is then installed within tank shell 12 without first performing an annealing operation thereon in order to complete fabrication of the expulsion tank.

By now referring specifically to FIG. 3, it will be understood that pre-rolling of preform 26 produces triaxial plastic strains in the diaphragm material forming incident to fabrication thereof. Thus, if a given circular element of side wall 26b of the preform is considered, such as that designated as $P_1$ and shown as having a diameter of $D_1$, it will be seen that the pre-rolling operation serves to plastically compress such element in a circumferentially extending hoopwise direction, such that a comparable circular element $P_1'$ of diaphragm 14 has a reduced diameter indicated as $D_2$. The excess material originally comprising element $P_1$ is caused to flow in two mutually perpendicular directions, such that the side wall thickness $t_2$ of element $P_1'$ is increased relative to the side wall thickness $t_1$ of element $P_1$, and such that the longitudinal dimension or thickness of element $P_1'$ is increased relative to that of $P_1$. The latter change in dimension will be apparent from viewing FIG. 3, wherein the longitudinal distance $L_1$ between given elements $P_1$ and $P_2$ of preform 26 is shown as being less than $L_2$ as measured between comparable $P_1'$ and $P_2'$ of diaphragm 14. Thus, diaphragm 14 has been cold worked and left with large residual stresses, which are directional and in three directions, such as to provide for improved rolling/buckling characteristics of diaphragm 14, as compared to an identically sized and configured diaphragm fabricated in a conventional manner.

As by way of specific illustration, tests conducted in connection with aluminum diaphragms indicate that the pre-rolling operation illustrated in FIG. 3 effects a reduction in diameter of the diaphragm relative to the preform on the order of about 6%, while the length and wall thickness of the diaphragm are each increased relative to the preform by about 3%. Subsequent rolling of diaphragm 14 upon itself to assume its fully inverted or tank empty configuration designated as 14" in FIG. 1, results in an increase in diameter of diaphragm 14" relative to diaphragm 14 on the order of about 7% to 8% and a decrease in length and wall thickness on the order of about 3% to 4%. Thus, the inverted diaphragm essentially assumes the configuration of the preform; there being a net growth in diameter of between 1% and 2%, and a net decrease in length and wall thickness of less than about 1%. Changes in size/configuration of the inverted diaphragm relative to the preform would be expected to vary depending upon the type of material selected for use in forming the diaphragm.

It will be understood that all cup-shaped diaphragms tend to resist a buckling load from externally applied pressure primarily by hoop compression. The plastic compression of each hoop element, which occurs during pre-rolling of diaphragm 14, serves to improve the material compression properties by cold work and leaves residual stresses that oppose the external pressure on each hoop element such that the present diaphragm's resistance to buckling has been substantially increased as compared to a non-pre-rolled diaphragm. However, pre-rolling compression of each hoop element also reduces the material yield strength in an opposite or tensile loading direction. This, together with the residual stresses favoring hoop element expansion, reduces the diaphragm's resistance to radially outward back rolling, ie. unrolling of the diaphragm during expulsion of the operation, to larger diameters of each hoop element. The pre-rolling plastic deformation of a hoop element in the radial and longitudinal directions also reduces the material yield strength in the opposite direction so that resistance to back rolling is reduced. This three axis reduction in material yield strength and the companion three axis residual stresses, both in directions opposite to the pre-rolling plastic strains, provide a controlled minimum energy path for subsequent back-rolling of the diaphragm. These directional effects tend to prevent circumferentially non-uniform rolling referred to as "lobing" and to reduce resistance of the diaphragm to rolling.

The mechanism of unrolling or back rolling a pre-rolled diaphragm is complex and the relative magnitudes of the several directional effects and their inter actions is not thoroughly understood. However, when certain materials are employed in fabricating the diaphragm, the net effect is to substantially increase resistance of the diaphragm to buckling without an increase in resistance to rolling, as in the case of aluminum, or to also result in a reduction in resistance to rolling, as in the case of stainless steel.

Figure 4:
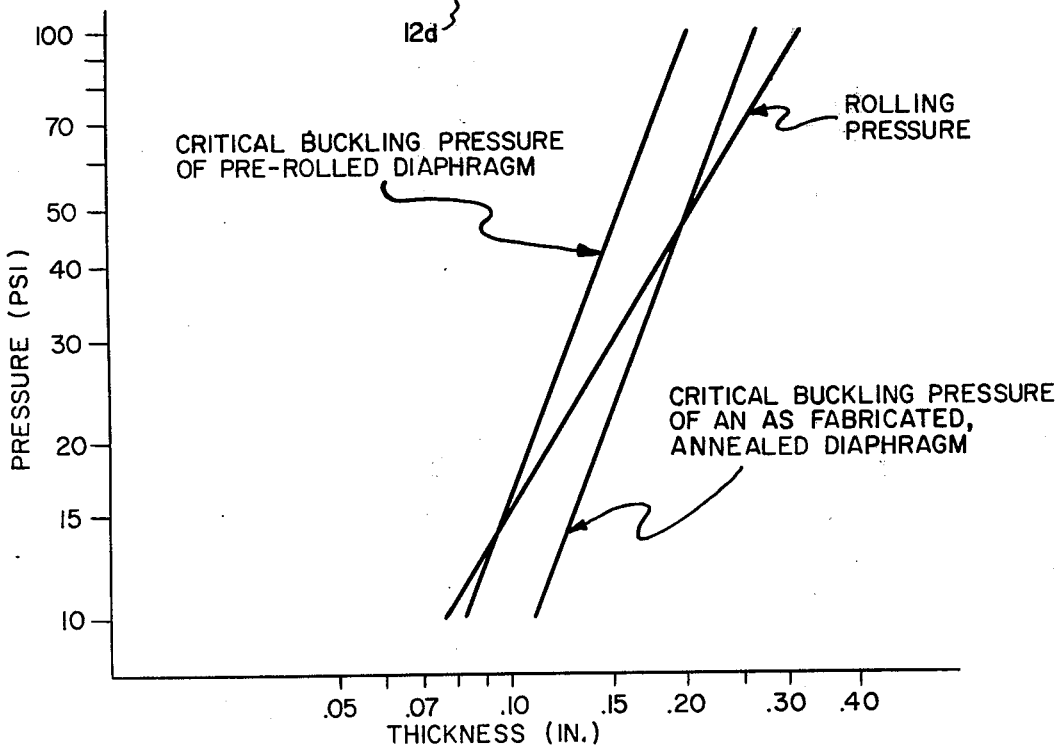
FIG. 4 is a diagram illustrating the relationship of rolling pressure and the critical buckling pressure for non-pre-rolled and pre-rolled forms of a frusto-conically shaped aluminum diaphragm.

The improved Pr/Pb relationship characteristic of an aluminum diaphragm fabricated in accordance with the present invention, as compared with that characteristic of an identically shaped and sized aluminum diaphragm fabricated from conventional techniques, is shown in FIG. 4, wherein Pr is rolling pressure and Pb is critical buckling pressure. More specifically, it will be understood by reference to FIG. 4 that for diaphragm side wall thicknesses of below about 0.1 inch, the pressure required to roll the diaphragm is greater than the critical buckling pressures of both pre-rolled and conventional diaphragms. Controlled rolling is not possible in this area because the diaphragms will buckle and collapse before the pressure reaches the level required to effect rolling. However, for wall thicknesses exceeding about 0.10 inch the pressure required to effect rolling of the pre-rolled diaphragm is substantially less than the critical buckling pressure and therefore controlled rolling is obtainable at or above this wall thickness. By comparison, the minimum wall thickness of a conventional diaphragm must be equal to or exceed about 0.20 inches and the expulsion pressure must be equal to or exceed about 45 psi before controlled rolling of a conventional diaphragm is obtainable. Thus, tests conducted on aluminum diaphragms have demonstrated that the pre-rolled diaphragm will roll out successfully at about half the thickness and one-third the pressure differential required for a conventionally formed diaphragm. The reduced wall thickness required for a pre-rolling diaphragm, and thus its tank shell as consequence of the reduced pressure differential required, provides for significant reductions in weight and costs of a positive expulsion tank. On the other hand, an advantage of the present diaphragm construction is a 50 to 100% product storage capacity increase over the capacity of a conventional diaphragm for any given wall thickness or diameter. This is due to the fact that the increased buckling resistance of the present diaphragm permits its length to be increased to approximately twice the length of a conventional diaphragm of the same side wall thickness and diameter. In addition to the conically shaped diaphragm illustrated in FIG. 1, these performance characteristics are also obtainable in the case of other cup shaped diaphragms, such as for instance the cylindrical, contoured conical and spherical diaphragms designated as 40, 50 and 60 in FIGS. 6–8.

A product compatible, fluid impervious material suitable for use in forming diaphragm 14 would normally be selected on the basis of its ability to undergo elastic deformation with a high ratio of stiffness to yield strength; its ability to store directional energy in residual stresses; its ability to develop directional properties (particularly yield strength) from the cold work of pre-rolling of the diaphragm preform; and on the basis of its having a plastic deformation capability greater than 10%. These material characteristics are employed in combination to obtain a low unrolling pressure relative to the critical buckling pressure for a diaphragm of a given geometry, such as to permit reliable unrolling or inversion of such diaphragm without the provision of auxiliary devices, such as guides, to prevent buckling. The above mentioned desirable material properties and characteristics are normally found in metals, and particularly in the case of pure aluminum, tin and beryllium. However, very high levels of one or more of these properties or characteristics, such as would be present in certain stainless steels, would be sufficient for permitting a good or controlled diaphragm unrolling operation, even though there are relatively low levels of the remaining properties or characteristics. Many metals and their alloys may therefore be utilized in the construction of the diaphragm of the present invention. On the other hand, a serious deficiency in one or more properties or characteristics, such as low stiffness or low plastic deformation capability would be expected to exclude a material from use in a pre-rolled diaphragm design. However, this does not specifically exclude synthetic materials that may be developed for achieving high levels of one or more of these properties or characteristics or combinations thereof.

Reference is now made to FIG. 5, wherein the diaphragm previously discussed in reference to FIG. 1 is shown as being modified to permit the maintenance of a constant rolling pressure differential across the diaphragm at all displacement positions thereof, whereby to effectively duplicate performance of a rolling cylinder diaphragm of constant thickness, such as that illustrated is FIG. 6. In that a constant rolling pressure condition requires the maintenance of a constant ratio of rolling diameter to diaphragm thickness at all displacement conditions, such conditions can be achieved in a frusto-conically shaped diaphragm by the expedient of essentially progressively decreasing the thickness of the diaphragm side wall **14*b'* from adjacent rim portion 14*c'* in a direction towards base portion 14*a'*, as indicated generally in FIG. 5**.

While the present invention has been disclosed with particular reference to its use in the fabrication of a metal diaphragm for a positive expulsion tank, it will be course be understood that such invention is broadly applicable to use in forming any article of revolution, which is required to be rolled upon itself during use in the absence of buckling deformation. The material utilized in fabricating the article would necessarily be compatible with its intended use in addition to possessing the advantageous characteristics discussed above with reference to materials suitable for forming diaphragm 14.

We claim:

1. A method of improving the resistance of a generally cup-shaped article to buckling deformation incident to rolling upon itself into an inverted configuration, said article being formed from a material of the type having its stress characteristics altered by cold rolling deformation, including the steps of fabricating an article preform having a configuration essentially corresponding to said inverted configuration of said article, annealing said preform as required to substantially reduce the presence therein of residual stresses produced by fabrication of said preform and pre-rolling said pre-form upon itself onto a mandrel to define said article and impart directional residual stresses and strains to said article tending to improve the resistance of said article to buckling deformation incident to rolling thereof upon itself into said inverted configuration.

2. In a method of fabricating an article having a side wall of essentially circular section and intended during use to be rolled upon itself into an inverted configuration in the absence of buckling defomation in response to a pressure differential applied across said article, the improvement including the steps of:

shaping material to form an article preform having a side wall configuration essentially corresponding to said inverted configuration of said side wall;

treating said preform as required to substantially reduce the presence therein of any residual stresses produced by fabrication of said preform; and completing fabrication of said article by inverting said preform by pre-rolling said side wall of said preform upon itself onto a mandrel resulting in the diameter of a given circular element of said side wall of said article being less than the diameter of a like circular element of said side wall of said preform, the wall thickness of said given element of said side wall of said article being greater than the wall thickness of said like circular element of said side wall of said preform and the distance between given circular elements of said side wall of said article being greater than the distance between like circular elements of said side wall of said preform, and said material being selected from a group of materials characterized in that the value of $P_R/P_B$ of said side wall of said article during rolling thereof upon itself in the absence of buckling deformation is less than that characteristic of said side wall of said article when not subject to the fabrication step of pre-rolling of said side wall of said preform upon a mandrel, wherein $P_R$ is rolling pressure and $P_B$ is critical buckling pressure.

3. In a method of fabricating an article having a side wall of essentially circular section and intended during use to be rolled upon itself into an inverted configuration in the absence of buckling deformation in response to a pressure differential applied across said article, the improvement for providing said side wall of said article with a value of $P_R/P_B$ less than that which would be characteristic of said side wall of said article if subject to an annealing operation prior to being rolled upon itself into said inverted configuration, wherein $P_R$ is rolling pressure and $P_B$ is critical buckling pressure, including the steps of:

forming an article preform having a side wall configuration essentially corresponding to said inverted configuration of said side wall of said article;

treating said preform as required to substantially reduce the presence therein of any residual stresses produced by fabrication of said preform; and inverting said preform to form said article by pre-rolling said side wall of said preform upon itself onto a mandrel.

4. In a method of fabricating an article having a side wall of essentially circular section and intended during use to be rolled upon itself into an inverted configuration in the absence of buckling deformation in response to a pressure differential applied across said article, the improvement including the steps of:

shaping material to form an article preform having a side wall configuration essentially corresponding to said inverted configuration of said side wall;

treating said preform as required to substantially reduce the presence therein of any residual stresses produced by fabrication of said preform; and pre-rolling said side wall of said preform upon itself onto a mandrel to form said article and impart directional residual stresses and strains to said side wall of said article tending to improve the resistance of said side wall of said article to buckling deformation incident to rolling thereof upon itself into said inverted configuration.

* * * * *